US006158997A

United States Patent [19]

Post

[11] Patent Number: 6,158,997

[45] Date of Patent: Dec. 12, 2000

[54] GEAR PUMP

[75] Inventor: Johannes Hermanus Nicolaas Post, Sassenheim, Netherlands

[73] Assignee: Fluid Management, Wheeling, Ill.

[21] Appl. No.: 09/345,233

[22] Filed: Jun. 30, 1999

[51] Int. Cl.[7] ..... F04C 2/00

[52] U.S. Cl. ..... 418/206.9; 264/278; 418/178

[58] Field of Search ..... 418/206.9; 264/278

[56] References Cited

U.S. PATENT DOCUMENTS

| | | | |
|---|---|---|---|
| 3,133,506 | 5/1964 | Luciani | 418/206.9 |
| 3,463,089 | 8/1969 | Newborough | 418/206.9 |
| 3,661,480 | 5/1972 | Forschner et al. | 418/179 |
| 3,881,849 | 5/1975 | Commarmot et al. | 418/206.9 |
| 4,744,738 | 5/1988 | Miki et al. | 418/206.9 |
| 5,253,988 | 10/1993 | Hunziker et al. | 418/1 |
| 5,466,131 | 11/1995 | Altham et al. | 417/420 |

FOREIGN PATENT DOCUMENTS

| | | | |
|---|---|---|---|
| 209788 | 8/1986 | European Pat. Off. | 418/178 |
| 61-192880 | 8/1986 | Japan | 418/178 |
| 62-020685 | 1/1987 | Japan | 418/178 |
| 63-117188 | 5/1988 | Japan | 418/178 |
| 3-179190 | 8/1991 | Japan | 418/178 |
| 404159482 | 6/1992 | Japan | 418/178 |
| 410103258 | 4/1998 | Japan | 418/178 |
| 2120728 | 12/1983 | United Kingdom | 418/178 |

*Primary Examiner*—Thomas Denion
*Assistant Examiner*—Theresa Trieu
*Attorney, Agent, or Firm*—Hill & Simpson

[57] ABSTRACT

A gear pump comprises a housing having an inlet and an outlet. A first and second gear each have gear teeth which are in engagement with each other. The first gear is a rotor gear which is journaled within the housing and is drivable. It includes means for driving the first gear in order to move relative to the second gear, such as to pump a fluid from the inlet to the outlet of the housing.

The housing includes inner housing parts encasing the gears and a single piece mold around the inner housing parts enclosing the gear pump.

11 Claims, 3 Drawing Sheets

GEAR PUMP

BACKGROUND OF THE INVENTION

1. Field of the Invention

The present invention relates to a gear pump for pumping fluids and other flowable materials, especially for use in a dispensing apparatus. More particularly, the gear pump may be used in a machine for making paints and the like consisting of a mixture of colorants dispensed from a container through a gear pump.

2. Description of the Related Art

Due to the environmental requirements, colorants for paint contain less lubricating components and are more abrasive. This has set high demands on gear pumps, and one of the ways of meeting the high demands is using ceramic parts, especially for the gears. The ceramic components are very reliable and wear resistant. Moving parts hardly need any lubrication between sliding surfaces thereof.

An example of a gear pump having ceramic gears is shown in U.S. Pat. No. 5,785,510. Another gear pump having ceramic gears is disclosed in EP-A-0 866 224.

SUMMARY OF THE INVENTION

It is an object of the present invention to provide an improved gear pump showing excellent properties, for example regarding reliability and sealing of the housing.

The object of the invention is obtained in a gear pump comprising:

a housing having an inlet and an outlet, at least first and second gears, each having gear teeth, said gear teeth of the first gear being in engagement with the gear teeth of the second gear, at least the first gear being a rotor gear which is journaled within the housing and is drivable and includes means for driving it in order to move relative to the second gear, such as to pump a fluid from the inlet to the outlet of the housing, wherein the housing includes a single piece molding around the gear pump housing enclosing the gear pump.

The gears are preferably made of ceramic material. In a preferred embodiment, the housing includes an inner housing of ceramic material and an outer cover of injection molded plastics material forming the single piece molding of the housing.

As a result of the invention, the housing has very good sealing properties since there are no seams between housing parts requiring seals. Also the assembly of the gear pump is facilitated. Especially when ceramic components are used, the gear pump is very durable and requires no maintenance. If the gear pump becomes defective, it should be replaced. The gear pump thus has a long term disposable character.

The invention also includes a method of making a gear pump comprising the steps of:

providing at least first and second gears;

providing an inner housing including at least two parts;

mounting the gears in the parts of the inner housing and assembling the parts to form the inner housing enclosing the gears;

placing the inner housing with the gears in a mold; and molding an integral cover around the inner housing to form a closed and sealed housing.

The invention will hereafter be further explained with reference to the drawing showing an embodiment of the invention by way of example.

DESCRIPTION OF THE PREFERRED EMBODIMENTS

Figure 1:
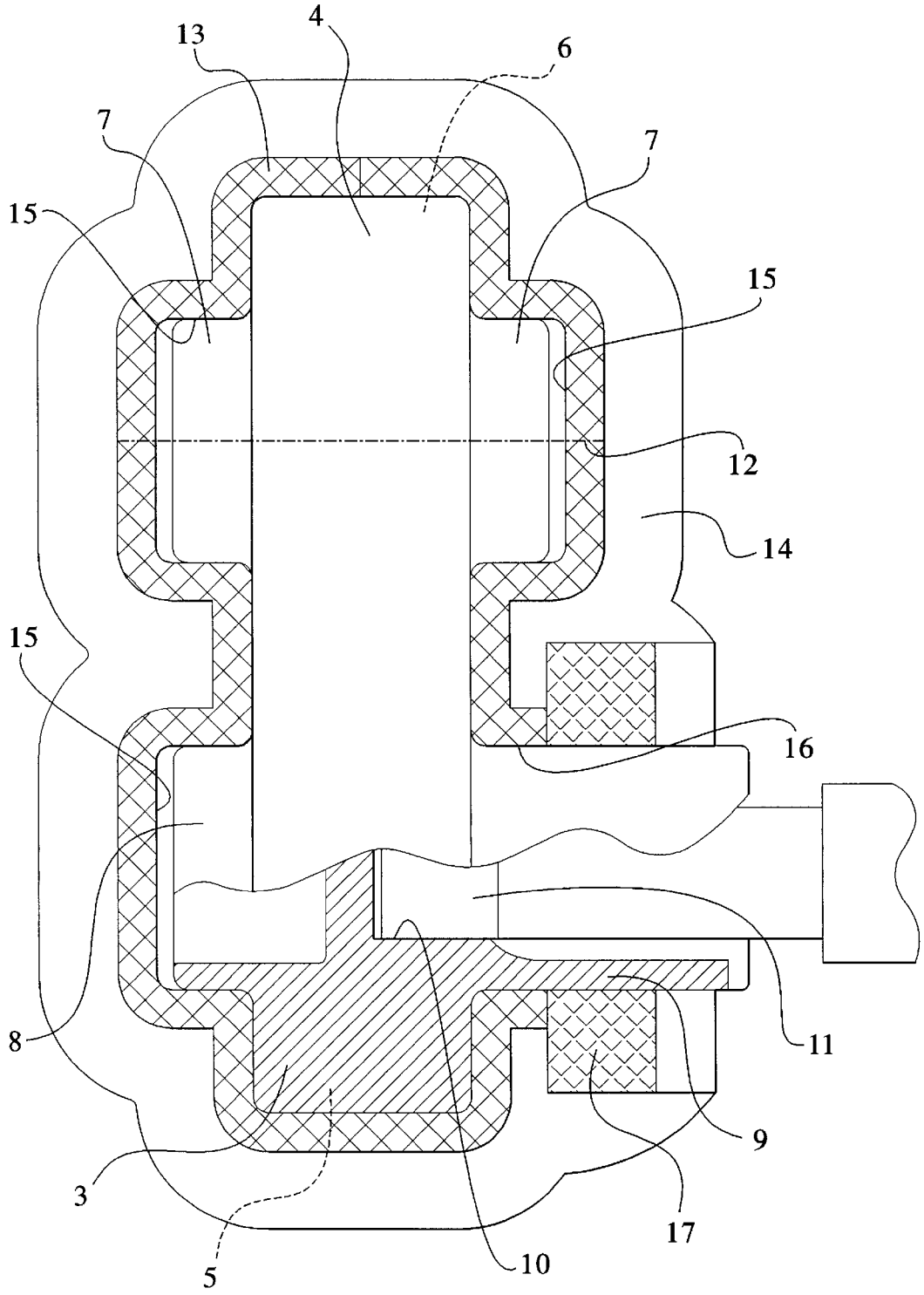
FIG. 1 is a very schematic cross-section of the embodiment of the gear pump according to the invention.
Figure 2:
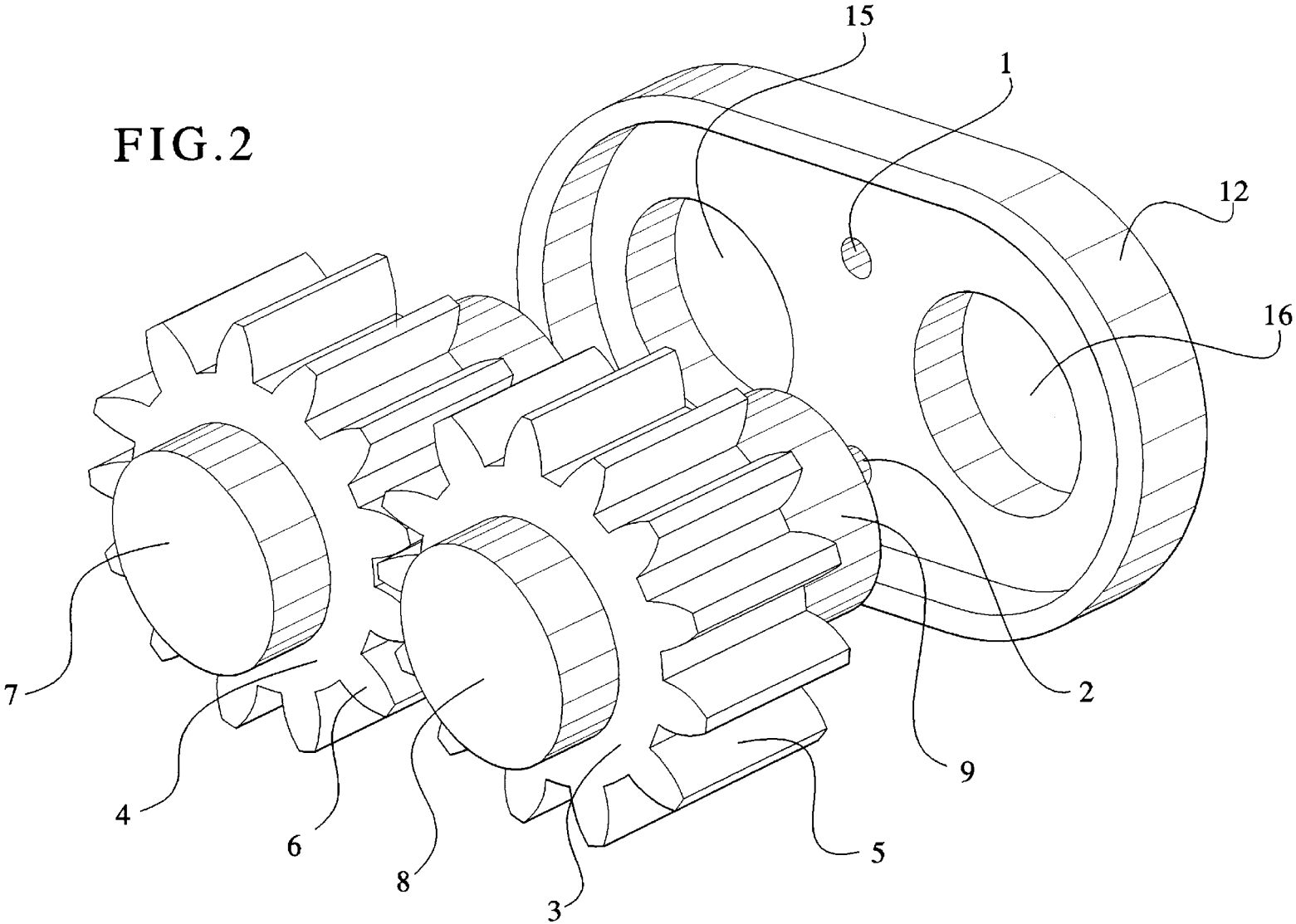
FIG. 2 is a perspective exploded view of the gears and an inner housing half of the gear pump of FIG. 1.

With reference to the drawing, particularly FIGS. 1 and 2 thereof, there is shown a gear pump for pumping fluids, in particular liquids such as colorants for making paints, from an inlet 1 to an outlet 2. This gear pump is specially for dispensing fluids with high precision and to obtain this, the pump includes two gears 3, 4, a driven rotor gear 3 and an idler gear 4, which are positioned with their axes parallel. The gears 3, 4 are of the same diameter and have the same number of teeth 5, 6 on their outer circumference. Said teeth 5, 6, being in engagement with each other in a sealing manner so as to transport fluid between the teeth from the inlet 1 to the outlet 2. The idler gear 4 has a shaft end 7 (which may be hollow) on both sides, whereas the rotor gear 3 has a shaft end 8 on one side and a drive shaft 9 on the other side. As shown in FIG. 1, the drive shaft 9 may be hollow and has an unround female coupling part 10 adapted to engage with a mating male coupling counterpart 11 which is connected to a drive of the pump (not shown). It will be understood that other drive couplings may be used such as splined, keyed, threaded, etc.

Both gears 3, 4 and their corresponding shaft ends 7, 8 or 9, respectively, are integrally formed and are made of ceramic material. Inserts may be used if desired.

The gears 3, 4 are housed in a pump housing. This housing includes two inner housing parts 12, 13 made of a ceramic material which encase the gears 3, 4 and forms the inner lining of a plastic cover 14 surrounding the inner housing parts 12, 13. The inner housing parts 12, 13 are oval-shaped such as to fit closely around the gears 3, 4 in order to define, together with the gears, inlet and outlet chambers adjacent the inlet 1 and outlet 2. Since the housing parts 12, 13 and the gears 3, 4 with their shaft ends 7, 8, and 9 are made of ceramic material, the shafts may, if desired, be journaled directly in bearing cavities 15, 16 without additional lubricant or separate bearings.

The bearing cavities 15 are blind holes, whereas bearing cavity 16 is a through-hole in order to allow the drive shaft 9 to be coupled to the drive. A Teflon (a product of DuPont) lip seal 17 or other type of seal seals the drive shaft 9 with respect to the respective inner housing part 13.

The housing parts 12, 13 fit closely at their facing surfaces and are able to form a seal therebetween during the molding process of the outer cover 14. Although the drawing shows housing parts which have equal depths for receipt of the gears, it will be understood that other shapes are possible. For example, the inlet and outlet chambers could be more or less entirely presented in only one housing part with the other housing part providing an end cap. Further, the facing surfaces of the housing parts may be provided with configurations enhancing alignability such as groves and ribs or spaces and recesses or enhancing sealability.

Figure 3:
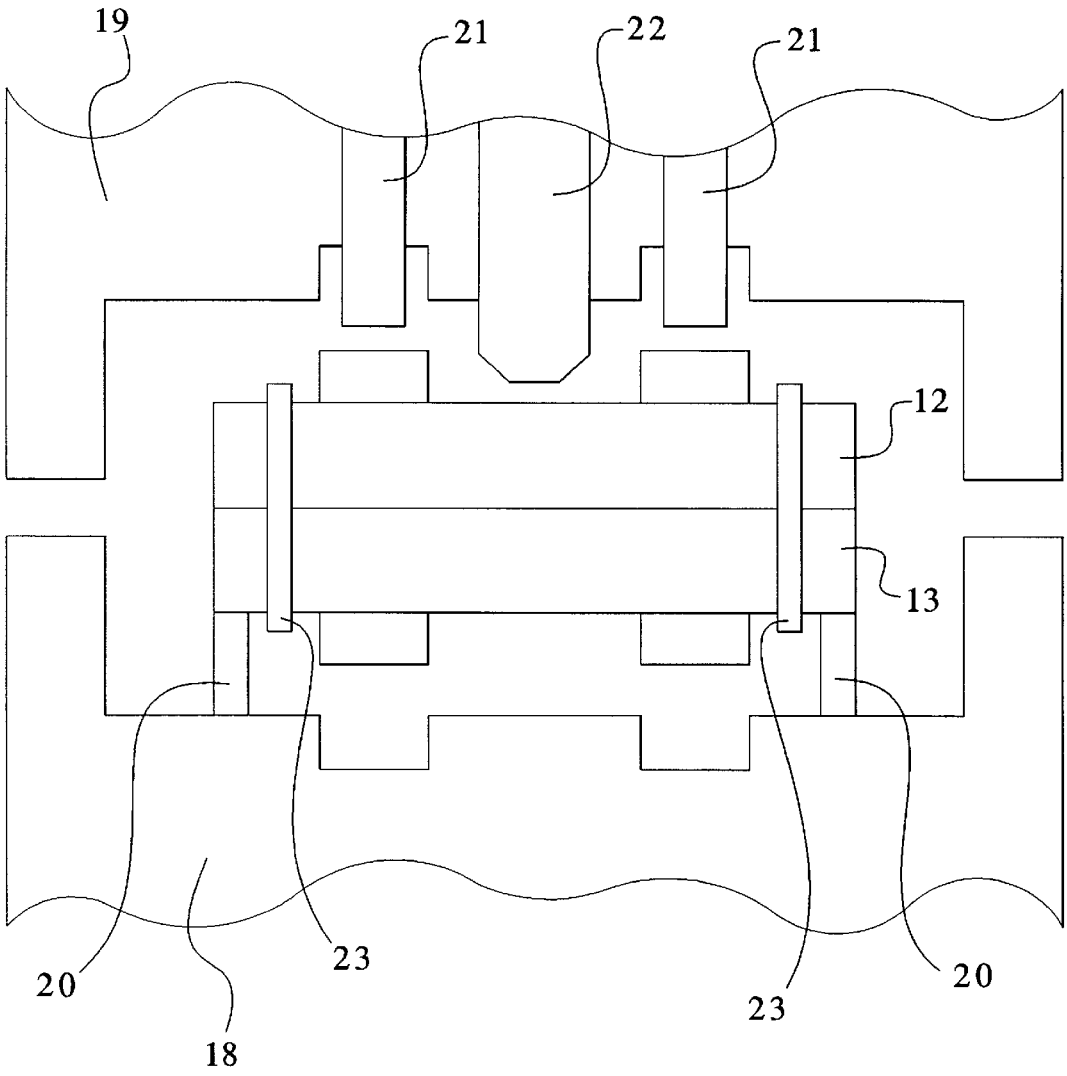
FIG. 3 is a very schematic cross-section of a mold for molding a plastic cover around the gear pump housing.

FIG. 3 schematically shows a mold for forming the plastic cover 14 by injection molding, said mold including known standard features such as molding halves 18, 19, support pins 20 within the mold, ejecting pins 21 and a schematically shown closing device 22 to close the inlet 1 and outlet 2 during injection molding. It will be appreciated that the inlet and outlet openings will align with openings in the molded cover and to this end the support pins may be removable pins inserted into the openings during molding and later removed from the molded cover. Not shown is a closing device for closing around the drive shaft 9 which projects through the through-hole of the bearing cavity 16. This closing device which may be a removable insert should also be shaped to form a cavity for accommodating the lip seal 17.

As is shown bolts, or the like in FIG. 3, the housing parts 12, 13 are held together by ties 23 so as to be enclosed by the cover in a correct position in which they seal the inner spacing thereof. After molding of the cover 14, the housing includes a single piece molded cover around the gear pump, enclosing the gear pump in a sealing manner. The inner housing parts 12, 13 then act as inner lining of the housing, which cooperates with the gears 5, 6. The cover 14 only includes openings for the inlet 1, outlet 2 and drive shaft 9. The cover 14 can be made of suitable plastics, such as nylon, delrin and other engineering plastics, which are stable and pressure resistant for a longer time. The ceramic parts are preferably made by injection molding and are then further processed by sintering. During the sintering step, the parts may shrink around 30%, which should be done in a reproducible manner. The bearing faces may be formed by grinding or other suitable process and the through-hole 16 by punching or the like.

From the foregoing it will be apparent that the invention provides a gear pump, which is easy to assemble, which is cost effective and does not need seals to seal housing parts.

The invention is not limited to the embodiment shown in the drawing and described hereinbefore, which may be varied in different manners within the scope of the invention. For example, the gears may also be as one stationary gear and one revolving gear. The cover of the housing may also be molded in another process.

I claim as my invention:

1. Gear pump comprising:

a housing defining a gear chamber having an inlet and an outlet, at least first and second gears in the chamber, each having gear teeth, said gear teeth of the first gear being in engagement with the gear teeth of the second gear, at least the first gear being a rotor gear which is journaled within the housing and is drivable and includes means for driving it in order to move relative to the second gear, to pump a fluid from the inlet to the outlet of the housing, wherein the housing includes a single piece molding around the gear pump enclosing the gear pump.

2. Gear pump according to claim 1, wherein the gears are made of ceramic material.

3. Gear pump according to claim 1, wherein the housing includes an inner housing of ceramic material and the molding is an outer cover of injection molded plastics material forming the single piece molding of the housing.

4. Gear pump according to claim 1, wherein the second gear is an idle gear wheel, and the first and second gears are rotatable around a respective axis and have external teeth.

5. Gear pump according to claim 4, wherein the axes of the first and second gears are substantially parallel.

6. Gear pump according to claim 5, wherein each gear is mounted on a shaft which is journaled in a respective cavity in the housing.

7. Gear pump according to claim 6, wherein the gears and shafts are integral one piece ceramic components.

8. Gear pump according to claim 2, wherein the inner housing includes two inner housing parts each including two cavities for the shafts of the first and second gears.

9. Gear pump according to claim 1, wherein the drive means of the rotor gear includes a drive shaft integrated with the rotor gear and extending to the outside of the housing through a sealed opening and comprising a coupling adapted to be coupled to a drive.

10. Gear pump according to claim 9, wherein the coupling includes a unround coupling part adapted to engage with a coupling counterpart.

11. Gear pump according to claim 9, wherein the sealed opening includes a TEFLON seal sealing against the drive shaft.

* * * * *